US006536743B2

(12) United States Patent
Selcer et al.

(10) Patent No.: US 6,536,743 B2
(45) Date of Patent: Mar. 25, 2003

(54) FIXED UMBILICAL CABLE FLOTATION DOCKING HEAD

(75) Inventors: Toby Selcer, College Station, TX (US); Joe Janac, Somerville, TX (US); David Janac, Caldwell, TX (US)

(73) Assignee: Dynacon, Inc., Bryan, TX (US)

( * ) Notice: Subject to any disclaimer, the term of this patent is extended or adjusted under 35 U.S.C. 154(b) by 86 days.

(21) Appl. No.: 09/852,310

(22) Filed: May 9, 2001

(65) Prior Publication Data

US 2002/0166998 A1 Nov. 14, 2002

(51) Int. Cl.[7] ..... B66D 1/00
(52) U.S. Cl. ..... 254/333
(58) Field of Search ..... 254/392, 413, 254/326, 335

(56) References Cited

U.S. PATENT DOCUMENTS

| | | | | |
|---|---|---|---|---|
| 3,966,171 A | | 6/1976 | Hale | |
| 4,319,372 A | | 3/1982 | Tausig | |
| 4,795,108 A | | 1/1989 | Appling | |
| 4,828,223 A | | 5/1989 | Russell et al. | |
| 5,197,716 A | | 3/1993 | Zibilich, Jr. et al. | |
| 5,199,659 A | | 4/1993 | Zibilich, Jr. | |
| 5,655,753 A | | 8/1997 | Berges et al. | |
| 6,082,947 A | * | 7/2000 | Adamson | 212/308 |
| 6,443,431 B1 | * | 9/2002 | Stasny et al. | 242/157.1 |

* cited by examiner

*Primary Examiner*—Emmanuel Marcelo
(74) *Attorney, Agent, or Firm*—McHale & Slavin, P.A.

(57) ABSTRACT

The instant invention teaches a docking head having a sheave which is capable of translating position within its plane or rotation so as to alter the placement of its axis of rotation, thereby allowing the docking head to safely accommodate umbilical cable mounted fixed floatation devices. The system senses the floatation presence and automatically shifts the sheave to allow trouble free passage of the floatation up to and including the step of latching the payload.

11 Claims, 8 Drawing Sheets

FIXED UMBILICAL CABLE FLOTATION DOCKING HEAD

FIELD OF THE INVENTION

This invention relates to the deployment and recovery of underwater equipment; particularly to the management of umbilical cables attached thereto; and more particularly to effective traversal of umbilical cables enshrouded with one or more means for flotation.

BACKGROUND OF THE INVENTION

Remotely Operated Vehicles (ROV) are unmanned, robotic submarines capable of operating at ocean depths of up to 10,000 ft. These vehicles are constantly increasing in capabilities, size and horse power, necessary for advanced research and/or working projects. The vehicles are linked to the surface vessel by use of an umbilical cable which provides electrical power, video feed and a structural tie to the recovery vehicle. With the increasing capabilities of these systems, the umbilical cable's strength had to be increased resulting in an increase in weight. This umbilical cable weight is a problem for the operation of the vehicle as it restricts mobility (an in water weight of 20,000 lbs is typical at 10,000' depth). To compensate for the increase in weight, operators may clamp on large high-density foam floats to the cable roughly every 40' for the first 500'. This results in the cable being neutrally buoyant the first 500' of umbilical cable allowing the ROV to have a 500' radius to operate in free of restriction. These floats have historically been applied manually by deck. Currently, a deckhand has to reach over the side of a vessel, grab the umbilical cable, pick up a 60 lb (air weight) float and clamp it on the umbilical cable with mechanical clamps. If the ship is heaving, this becomes a very dangerous and painstakingly slow procedure. When the vehicle is being recovered, these floats must be removed as they will not fit through the sheaves and/or wind onto the umbilical cable winch drum. There has never been an automated method developed for this process and manual methods are still being used today.

A known float system employs the use of clamps to affix segments of flotation material to the umbilical cable starting at the ROV and continuing up the umbilical cable to the required length. This flotation device, marketed under the name LINKSYN is interlocked by segments in a fashion similar to the vertebrae in one's back-bone, allowing the flotation to stay on the umbilical cable. Each segment is approximately 10" in diameter and 12" long. This type of umbilical cable flotation, or any fixed umbilical cable flotation of similar construction, reduces or eliminates the dangerous handwork required with the prior art systems during launch and recovery. However, problems arise in utilizing a standard docking head, which now has to handle two cable diameters. For example, a first umbilical cable diameter, roughly 1.5" in diameter), and a second flotation diameter of approximately 11 inches, may be routed through the docking head. This shift in diameter causes the umbilical cable centerline to rise roughly 5" on the sheave radius causing the latch and bell mouth alignment to be thrown out to a point where they will not function without jamming.

DESCRIPTION OF THE PRIOR ART

U.S. Pat. No. 5,655,753 discloses a marine seismic cable deployment and retrieval system for utilization in conjunction with a marine vessel. The patent teaches a large wheel mounted in the front of the vessel for retrieving seismic cable from the water, and a horizontally mounted cable handler comprising an eight wheel cable puller for pulling the cable, the cable puller comprising four pairs of tires in frictional, rotational contact with one another along their outer surfaces configured to frictionally grab and pull a seismic cable along a linear path. A smaller rear cable puller further urges the cable to the rear of the vessel, and down into the main deck via a chute arrangement. The cable pullers of the present invention contemplate the utilization of relatively oversized, under-inflated tires to allow for a softer, increased frictional contact with the cable, while allowing for the tires to "give" with the passage of cable connectors therethrough, which typically have a greater diameter than the cable, allowing for full, real-time cable retrieval. The present system further contemplates a trolley assembly/floating cable puller system for deploying the cable into the main deck for installation, as well as deploying the cable to sea, which trolley system includes a floating cable wheel puller arrangement having movement on both the longitudinal and transverse axes of the vessel, allowing flexible placement of the cable in the main deck area.

U.S. Pat. No. 5,199,659 discloses a marine cable retrieval apparatus for retrieving marine seismic cable on board a ship which reduces longitudinal tension force on the cable at the cable storage reel when the cable storage reel (drum) is winding up the cable. Marine cable is subject to a tension force which can damage the marine cable when it is placed on a storage reel. The apparatus of this application reduces the tension on a portion of marine cable so that the portion can be retrieved upon a storage reel. The apparatus includes a collar attached to the marine cable and a cable retrieval tool which is placed around the marine cable. The cable retrieval tool has a biasing mechanism which will allow the tool to pass over the collar attached to the marine cable when it is moving away from the ship, but when it is moving toward the ship the biasing mechanism will engage the collar. The cable retrieval tool exerts an opposing force on the collar to the longitudinal tension force on marine cable trailing behind the collar. This reduces the longitudinal tension force on a portion of cable between the cable retrieval tool and the cable storage reel. The cable storage reel can then wind up the portion of cable with a reduced longitudinal tension on the cable at the cable storage reel.

U.S. Pat. No. 5,197,716 provides a marine cable deployment apparatus for deploying marine seismic cable from a ship which reduces tension force on the cable at the cable storage reel when the cable storage reel (drum) is winding out the cable. Marine cable is subject to a longitudinal tension force which can damage the marine cable when it is deployed from a storage reel. The apparatus of this application reduces the longitudinal tension force on a portion of marine cable so that the portion of cable can be deployed from a storage reel. The apparatus includes a collar attached to the marine cable and a cable deployment tool which is placed around the marine cable. The cable deployment tool has dogs which engage the collar and a locking ring which holds the dogs in place. The cable is deployed with the deployment tool accompanying the deployed cable. A line between the deployment tool and the ship provides an opposing force to the longitudinal tension force on the cable trailing behind the collar. After the portion of cable is deployed the opposing force on the cable retrieval tool is reduced to a point that the deployed portion of cable assumes the longitudinal tension force on the cable trailing behind the collar. The tension on the line is released. The locking ring slides back on the deployment tool releasing the dogs from the collar. The deployment tool is pulled back along the cable to the ship to attach to the next portion of cable to be deployed.

U.S. Pat. No. 4,828,223 teaches a cable handling apparatus which draws in a cable, such as a seismic streamer, along a generally linear path and feeds the cable to a winch which winds in the cable from the apparatus under constant tension.

U.S. Pat. No. 4,795,108 teaches a level wind system suitable for winding an elongated sonar array onto and off from a storage drum and includes a guide member which guides the array into a counterbalanced free pivoting arm having a large radius arcuate section terminating substantially in tangential relationship to said drum and which uses the tension force on the array to continually reposition itself relative to each previous wrap on the drum. A series of rollers are located on the inside surface of the arm to guide the array and to minimize the forces on the array. A pair of spring-loaded rollers are positioned between the storage drum flanges which hold the array in position and prevent slack from developing during power-off situations.

U.S. Pat. No. 3,966,171 is drawn to apparatus for launching, towing and recovering a submersible and towable body from a vessel and includes a saddle, a winch and cable spooling and tension apparatus. The saddle includes a roller box which is rotatable about the axis of the tow sheave to maintain constant pressure against the cable during towing. A skewable A-frame for lowering the saddle near the water surface includes a transom arm which is pivotally mounted to the transom and to the tow sheave. The winch may be a multi-drum assembly, where the drums are co-axially mounted; and the drums are rotatably mounted in peripheral bearings at each end, which are mounted in the ends of the winch enclosure. The winch enclosure has a cover plate with a transverse slot to permit reeling and unreeling of cable from a drum. A latch mechanism provides for positive locking of a drum for rotation or non-rotation, depending on whether it or another drum is the one on which cable is being reeled or unreeled. The drums of a multi-drum assembly also have a transverse slot formed in them; and the lips of each slot are profiled to turn inwardly with a smaller apparent radius of curvature than the nominal radius of the drum.

U.S. Pat. No. 4,319,372 provides apparatus for delivering a heavy cable such as a rescue cable from the ocean's surface to an extended depth for attachment to an object such as a stranded submarine and, after attachment of the free end of the cable to the object, delivering the cable to the ocean's surface. A syntactic foam float provides positive buoyancy for a frame assembly which supports a cable reel holding the heavy cable. Releasable ballasts are included to provide an initial overall buoyancy of a small negative value during the descent of the apparatus. A release system is provided to simultaneously release the releasable ballast to change the buoyancy of the apparatus to a positive value, release the cable reel to allow cable payout. The cable reel is coupled to a waterbrake system which limits the rate of cable payout to below the rate of ascent of the rescue cable reel. The waterbrake system includes a depth-activated clutch which engages a secondary waterbrake to slow the rate of cable payout near the ocean surface.

What is lacking in the art is a cable deployment and retrieval device wherein the docking head contains a sheave designed to have a variably and adjustably positionable axis of rotation such that, upon sensing variations in the umbilical cable diameter, e.g. due to the presence/absence of the fixed umbilical cable flotation segments, said sheave is adjustably positioned within said sheave plane of rotation. so as to safely accommodate said variable diameter umbilical cable.

SUMMARY OF THE INVENTION

ROV manufacturers, desirous of using the LINKSYS fixed floatation system or any similar and functionally equivalent system which places a permanent section of significantly greater diameter about the umbilical cable, require development of a system to accommodate the varying diameters required. The instant invention teaches a docking head which is capable of translating the sheave position to accommodate variations in the diameter of the umbilical cable, e.g. the presence of the fixed floatation device thereon. The system senses the floatation presence and automatically shifts the sheave to allow trouble free passage of the floatation up to and including latching.

When the instantly disclosed fixed flotation docking head is utilized with the fixed flotation umbilical cable system, enormous benefits accrue. Extraordinary saving in time are realized while simultaneously eliminating a dangerous manual procedure. The new docking head is designed to accommodate the fixed flotation system with no impact to operations.

Accordingly, it is an objective of the instant invention to provide a docking head having a movable sheave adapted to accommodate multiple diameter umbilical cables.

It is a further objective of the instant invention to provide a docking head wherein sheave movement is controlled via an umbilical cable diameter sensing mechanism.

It is still an additional objective to provide a movable sheave which is capable of simultaneously maintaining a constant tension upon an umbilical cable to avoid unwanted slack in the cable.

It is still a further objective of the instant invention to provide means for rotation and retraction of the docking sheave without operator intervention.

These and other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
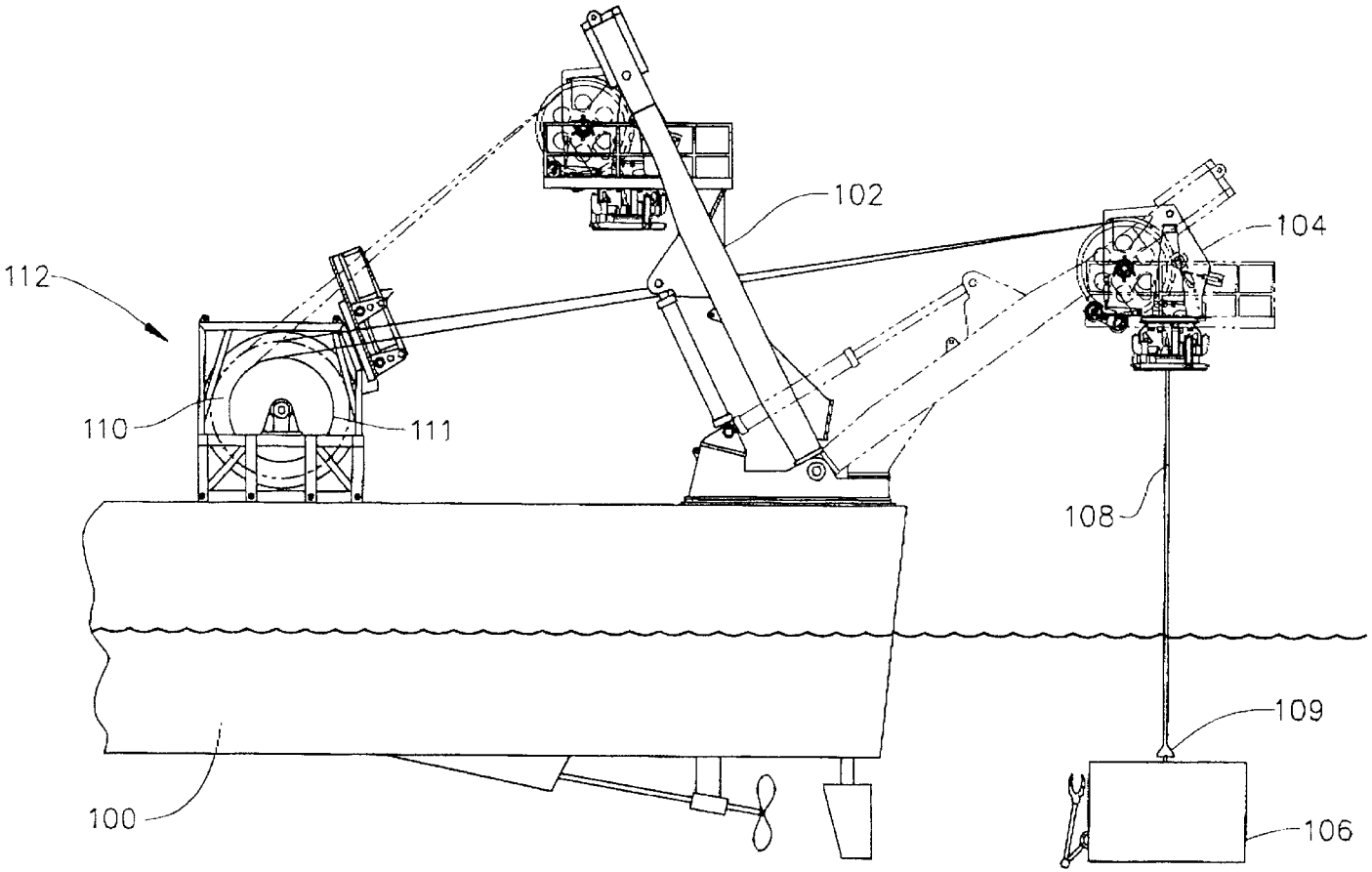
FIG. 1 is a perspective view demonstrating a typical ROV launch and recovery.

With reference to FIG. 1, a typical installation is shown for shipboard deployment/retrieval of a tethered payload/device, illustrated by, but not limited to a Remotely Operated Vehicle (ROV). A vessel 100 is provided, upon which is mounted a pivotable A-frame 102 within which is positioned a docking head 104. An ROV 106 is illustrated at a point below the water's surface, tethered to the vessel 100 via an umbilical cable 108 at a first end 109 and to the drum 110 of winch assembly 112 along a second end 111. In general, the vessel interacts with the ROV by operating the winch to raise and lower the vessel while maintaining the umbilical cable 108 centered within the sheave 114. The umbilical cable 108 is utilized for a variety of purposes, e.g. as a security tether and means for raising and lowering the vessel, for supplying power to the ROV, for communication, and the like. As the umbilical cable is used to facilitate additional tasks, the weight of the umbilical cable is ever increasing, resulting in the ROV being hampered in its movements. As a means of neutralizing the hindrance of the umbilical cable, it is known to apply flotation means (not shown) such as a plurality of segments, along the length of the umbilical cable 108. In a preferred embodiment the flotation is applied in an amount effective to render approximately 500 feet of the umbilical cable closest to the ROV neutrally buoyant. Prior art methods which utilized a fixed sheave docking head design, applied segments of fixed flotation manually as the payload (e.g. the ROV) was deployed and subsequently removed them in a similar fashion as the payload was retrieved.

Figure 2:
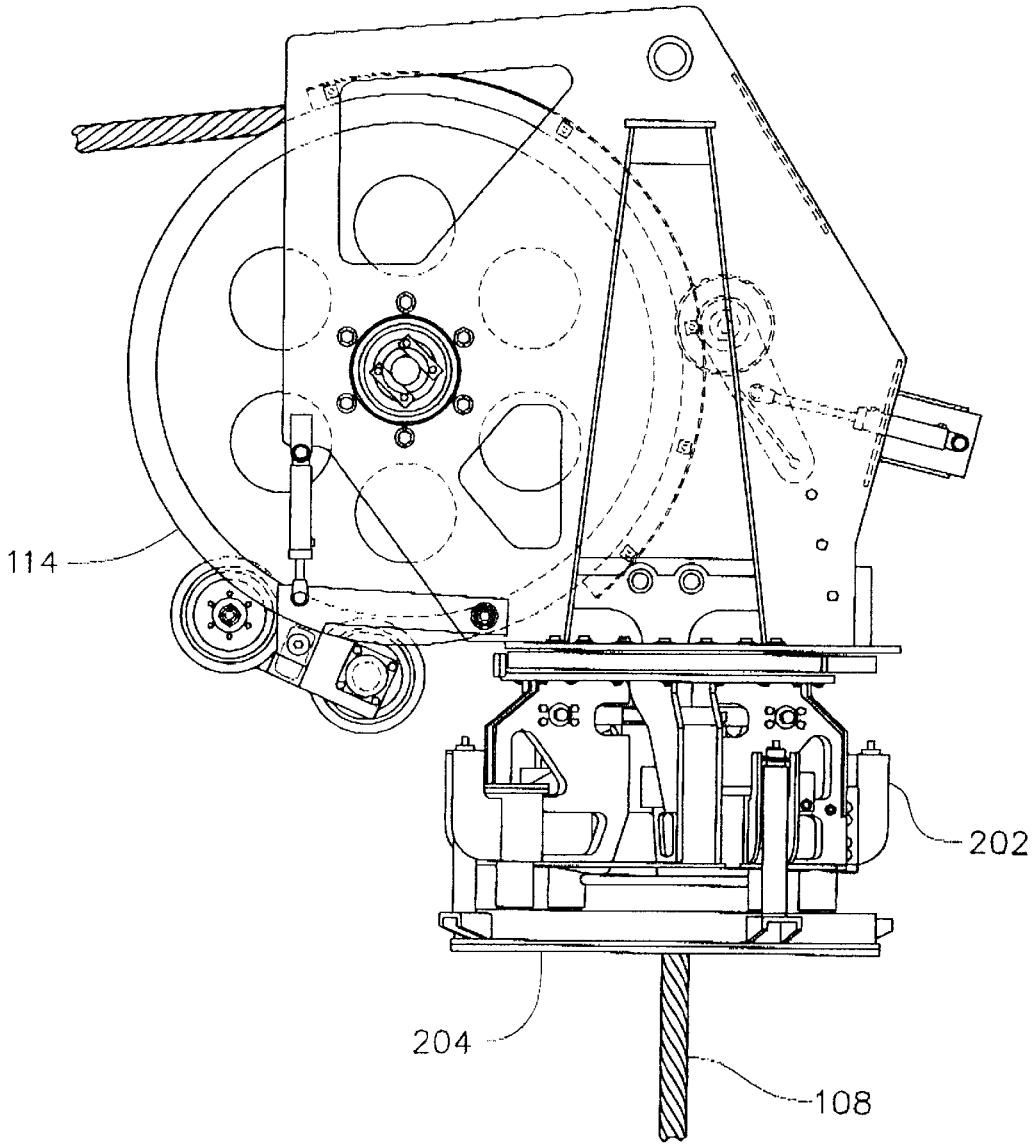
FIG. 2 is a plan view of a standard fixed sheave docking head.

As seen in FIG. 2, the fixed sheave docking head 200 can only accommodate an umbilical cable having a diameter within the range of its design configuration. If a larger diameter is utilized, the umbilical cable 108 is moved to a position out of center with the latch 202 and bell mouth 204 preventing the umbilical cable 108 from being retrieved smoothly. This can create a dangerous situation, especially if the umbilical cable should jump out of alignment with the sheave 114 and bind or jam.

Figure 3:
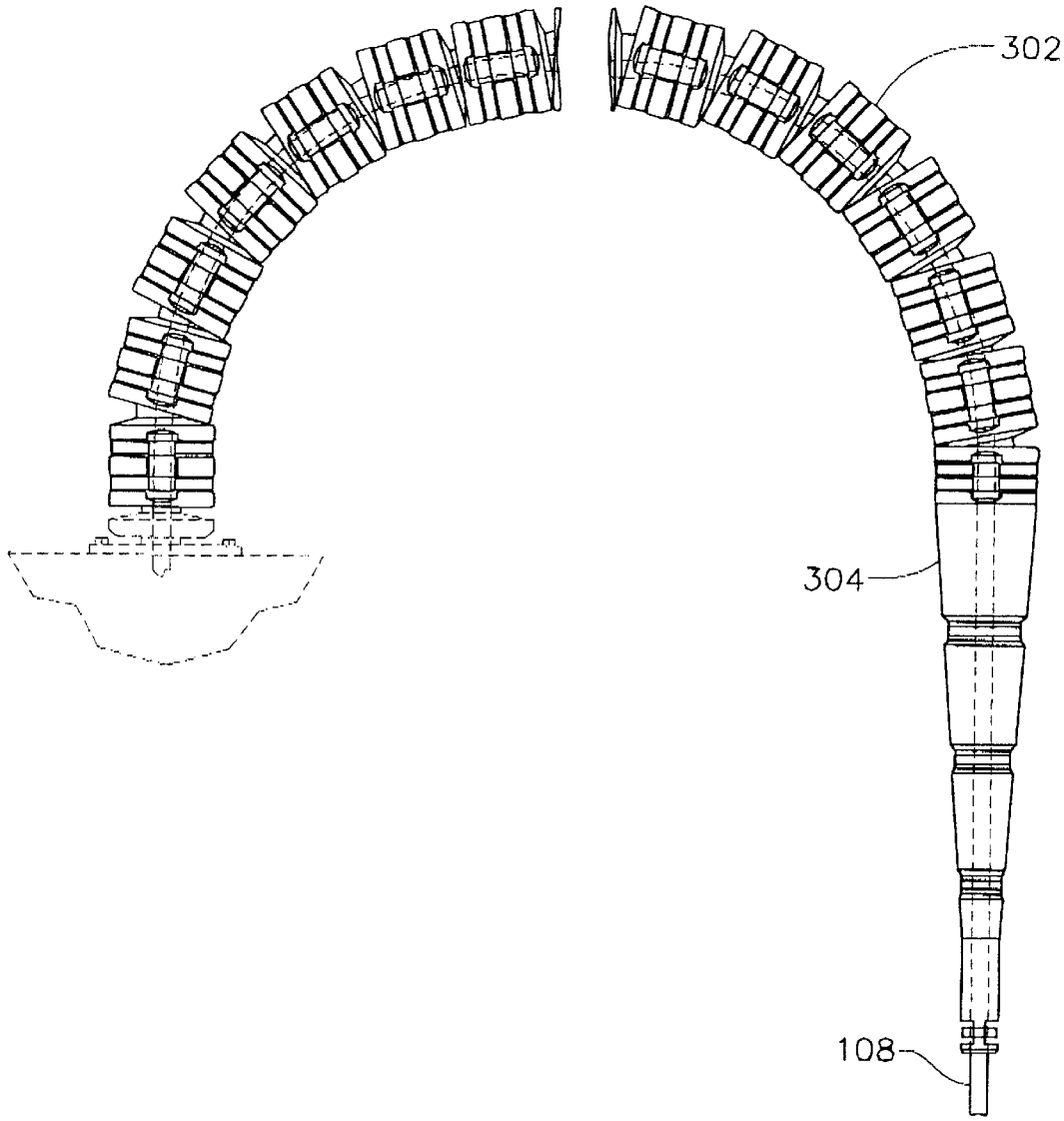
FIG. 3 is a perspective view showing deployment of a LINKSYN umbilical cable flotation arrangement about an umbilical cable.

Referring to FIG. 3, the umbilical cable flotation system 300 has been developed and is marketed under the name LINKSYN. The LINKSYN flotation system is comprised of a plurality of similar segments 302 interlocked in a fashion similar to the vertebrae of one's back-bone, allowing the flotation to stay on the umbilical cable. These segments 302 are each roughly 10" in diameter and 12" long. At the umbilical cable exit, several segments 304 are tapered to effect a transition area of gradually increasing/decreasing diameter. This type of umbilical cable flotation, or any fixed umbilical cable flotation of similar construction, eliminates all the dangerous handwork required with the prior art systems during launch and recovery. Problems arise, however, in utilizing a standard docking head, which now has to handle two cable diameters, for example a first umbilical cable diameter, roughly 1.5" in diameter), and a second flotation diameter of approximately 11 inches. This shift in diameter causes the umbilical cable centerline to rise roughly 5" on the sheave radius. This throws the latch 202 and bell mouth 204 alignment (see FIG. 2) out to a point where it will not function without jamming.

Figure 4:
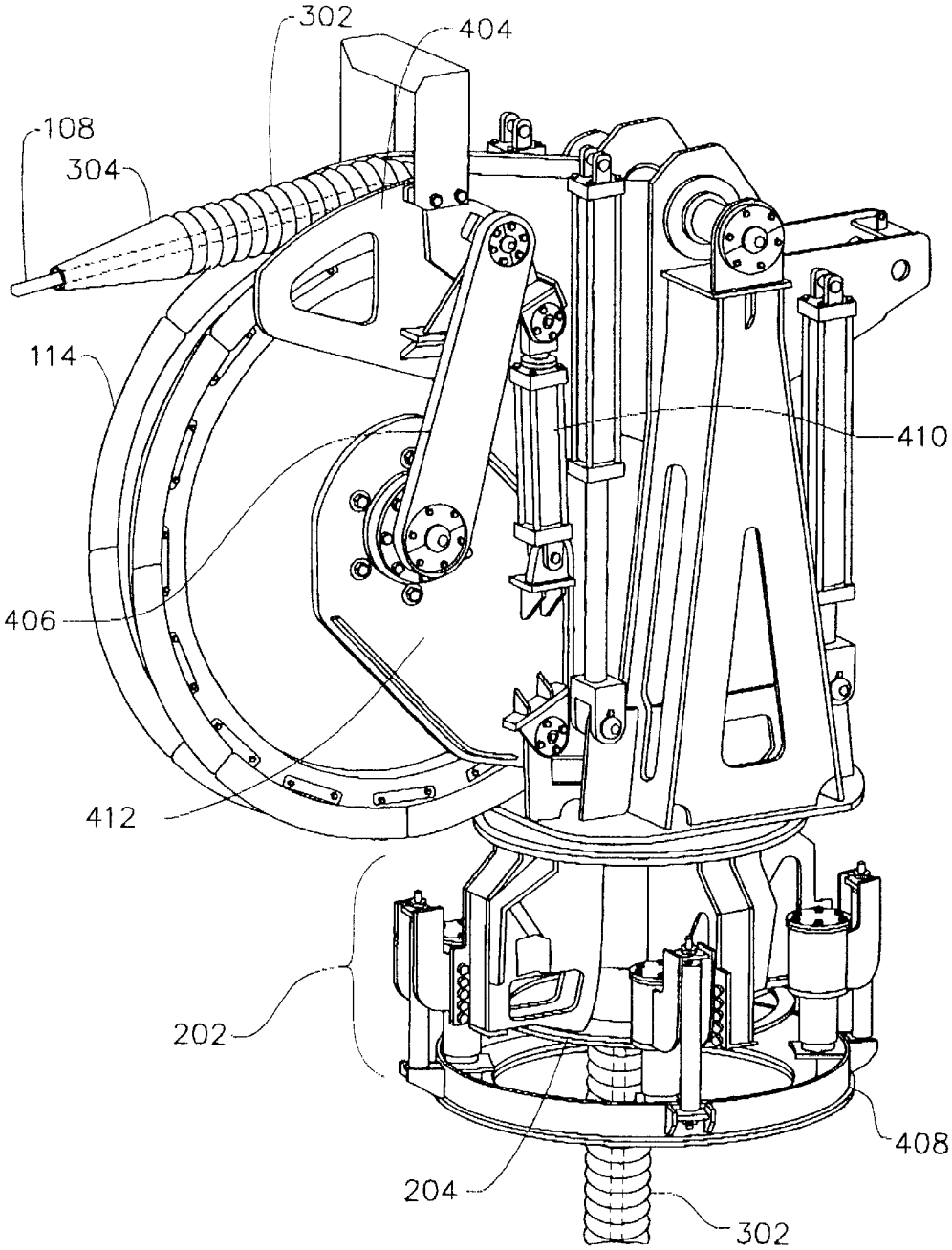
FIG. 4 is a perspective view of one embodiment of a movable sheave docking head positioned for traversal of the fixed flotation section of an umbilical cable.

As depicted in FIG. 4, the instant invention provides a docking head 400 having a movable sheave 114. An over center link 404 is positioned above the sheave 114 and maintained at a given distance therefrom via stabilizing arms 406. Upon reaching the area of the snubber ring 408 the fixed flotation (302) enshrouded umbilical cable 108 activates a sensing device, not shown. The sensing device is a detection means which is controllably coupled, e.g. in electrical and/or mechanical communication with an adjustable sheave positioning device, e.g. a sheave actuating cylinder(s) 410. Upon sensing variations in cable diameter, the means for adjustably positioning cause said sheave to be adjustably positioned within said sheave plane of rotation. This is exemplified when the presence of the fixed flotation 302 about the umbilical cable 108 causes the sensor to energize the cylinder(s) 410 and lower swing arm 412. This causes the position of the sheave 404 to be translated forward approximately 5" to accommodate the umbilical cable 108 and fixed flotation 302. The over-center link 404 simultaneously rotates to maintain the umbilical cable centered in the bell mouth 204 and maintain exit height. Upon the ROV being fully retrieved, the umbilical cable is captured in latching mechanism 202.

Figure 5:
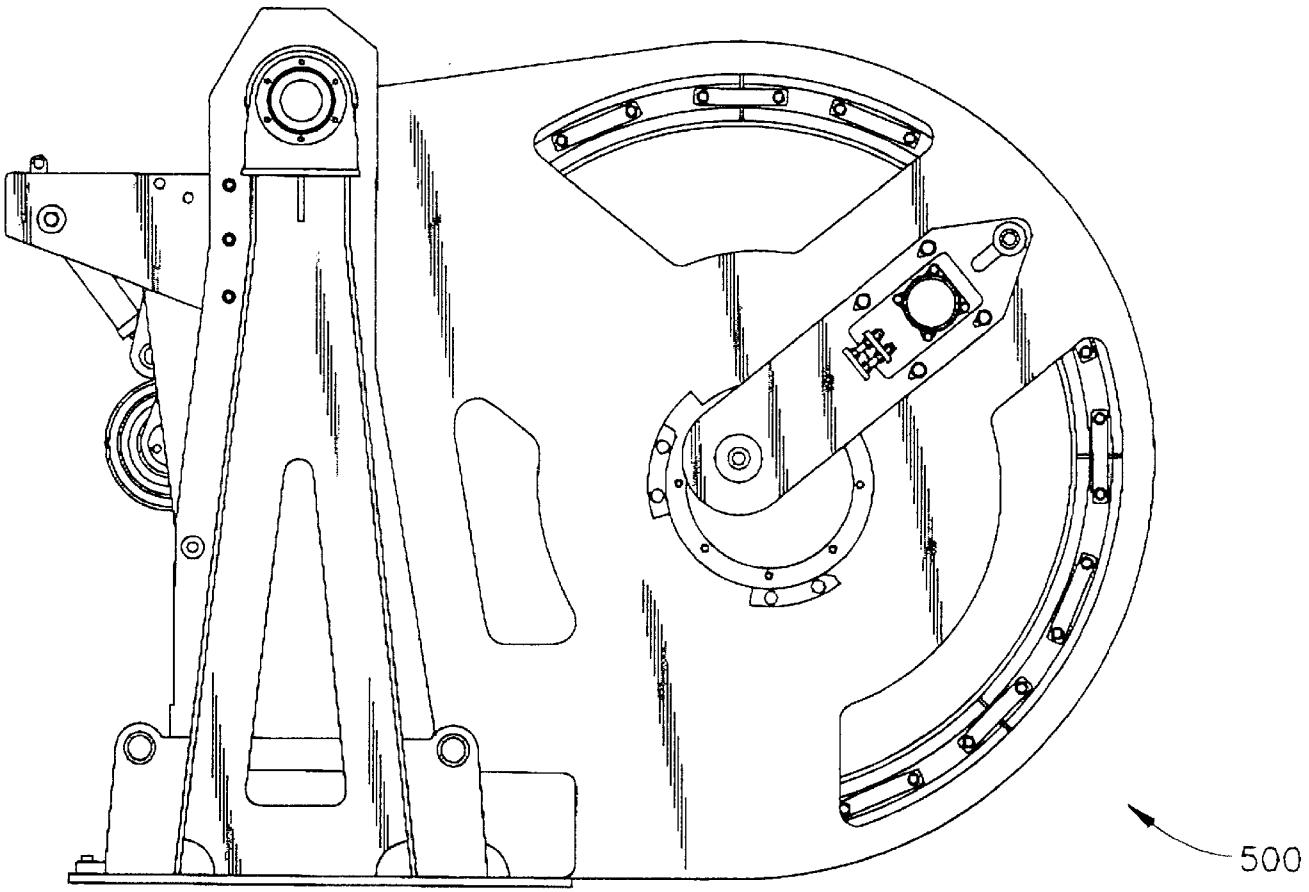
FIG. 5 is a cut-away view of an alternative adjustable sheave in its retracted position.
Figure 5A:
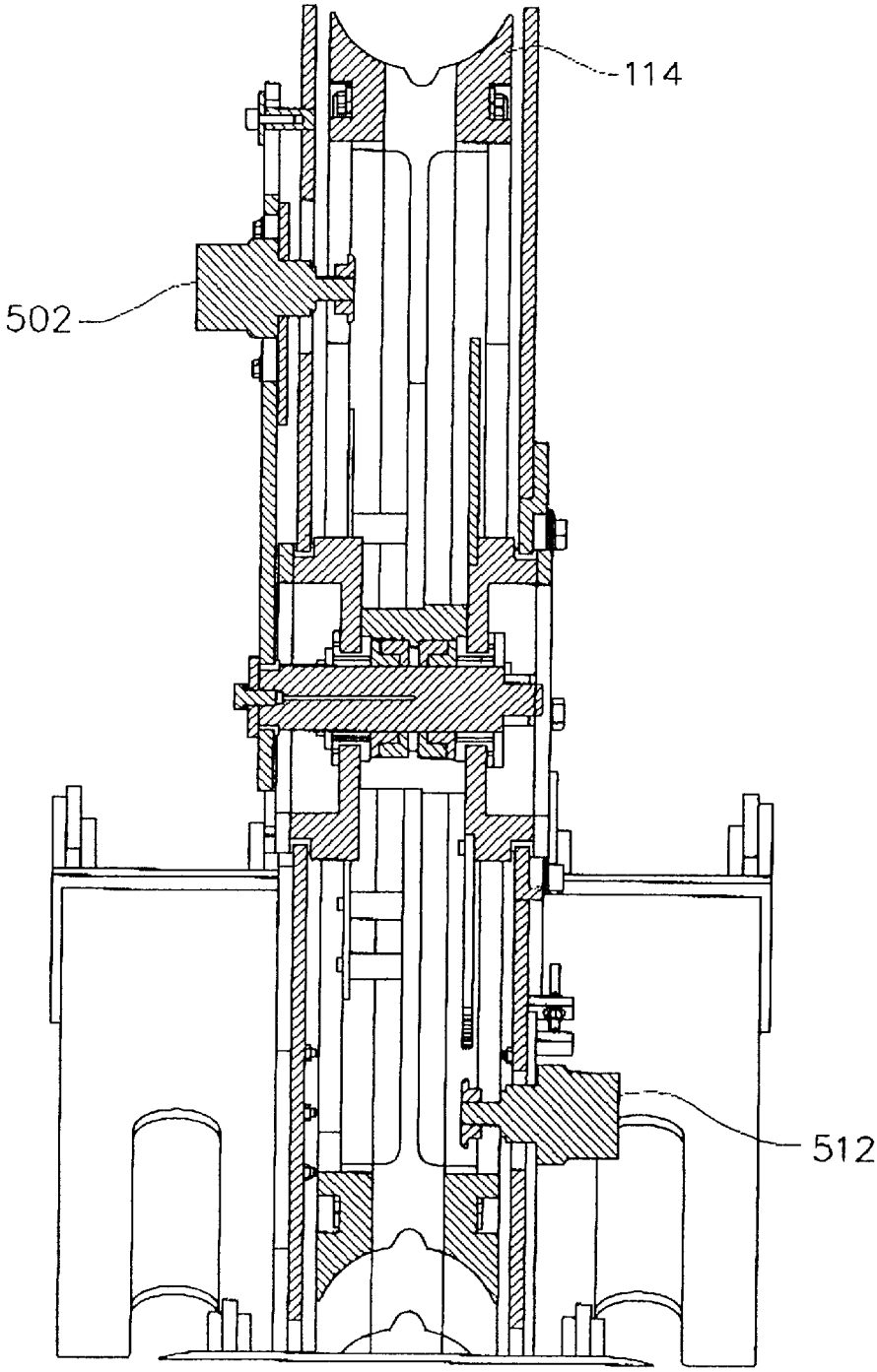
FIG. 5A is a side view of FIG. 5.
Figure 6:
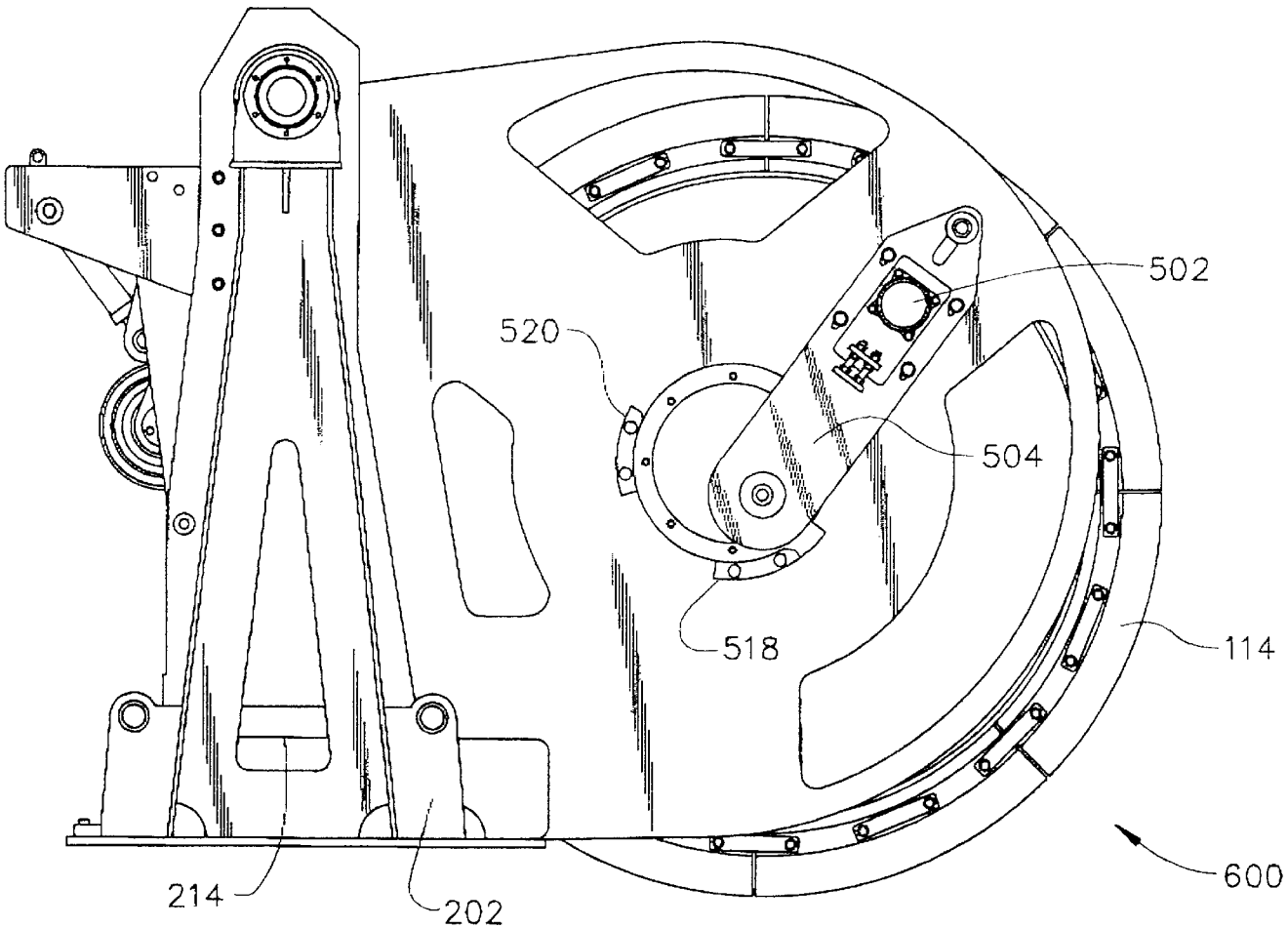
FIG. 6 is a cut-away view of an alternative adjustable sheave in its fully rotated position.
Figure 7:
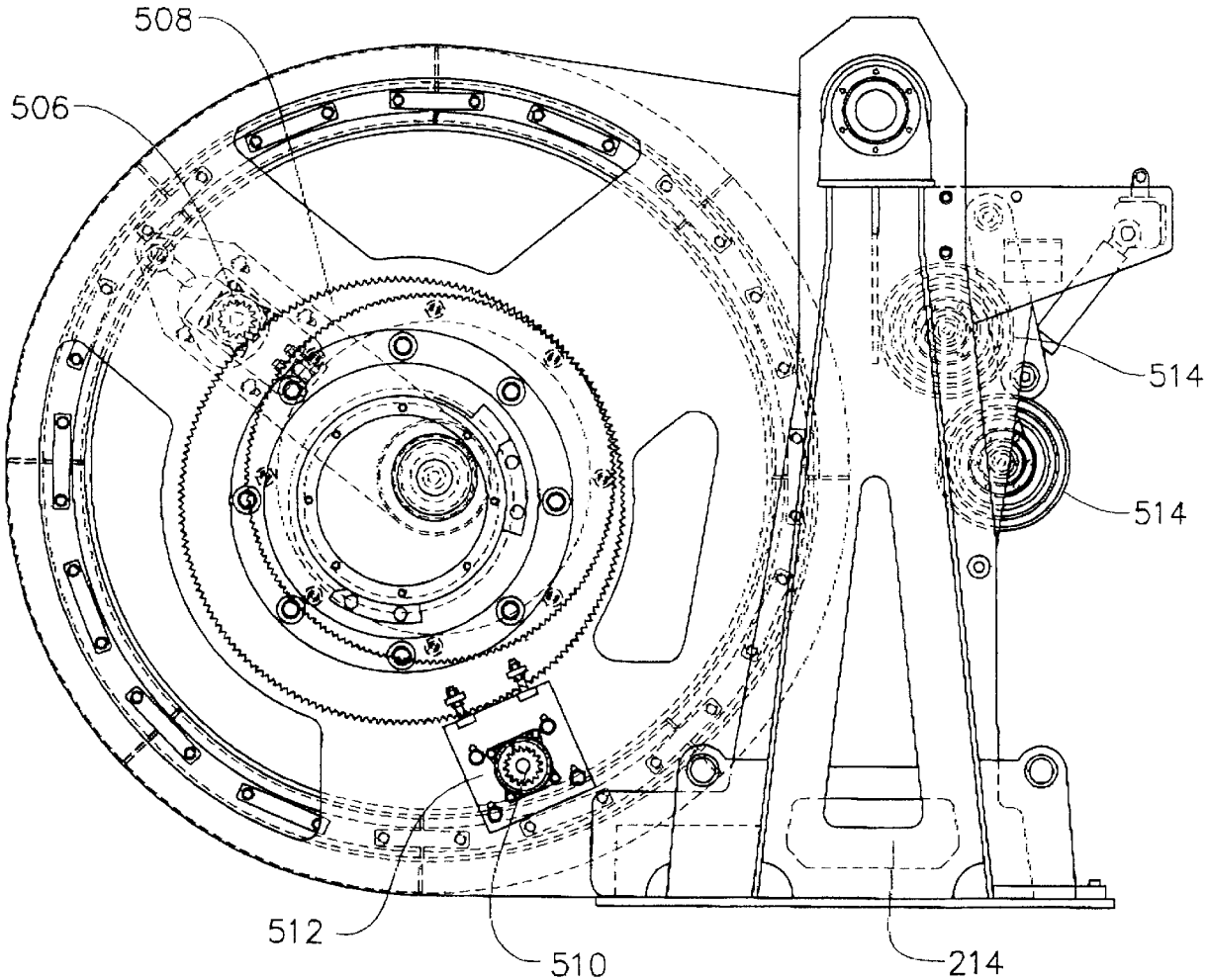
FIG. 7 is an opposite side cut-away view of FIG. 5.

As further shown in FIGS. 5, 5A and 6, (in which like numerals will refer to equivalent elements of FIG. 4) an alternative embodiment of an adjustable sheave docking head is shown. FIGS. 5 and 6 represent an alternative movable sheave docking head in its fully retracted 500 position (FIG. 5) and fully extended/rotated position 600 (FIG. 6) respectively. Umbilical cable 108 (not shown) follows a vertically upward path through the bell mouth 204 and rests upon the sheave 114. A first sprocket driving means, which is illustrated as, but not limited to a hydraulic motor 502 is mounted on docking head rotating arm weldment 504. When energized, motor 502 serves the function of a sprocket driving means and rotates a drive sprocket 506 which is in engagement with a first sprocket 508 (see FIG. 7), which is coaxial with the sheave 114 and acts to maintain the sheave in a constantly rotating state, thereby preventing a slackened condition of the umbilical cable as a result of unexpected relative movement between the payload (e.g. the ROV) and vessel. A second sprocket 510 engages the drive sprocket of a second sprocket driving means, which again may be exemplified, but not limited to, a hydraulic motor 512, which motor is energized upon deflection of idler cams 514, in response to contact by the flotation enshrouded portion of the umbilical cable 108. Upon energization, motor 512 acts as a sprocket driving means and causes sprocket 510 to rotate between a first limit position 518 and a second limit position 520. Due to the eccentric positioning of sprocket 510 relative to the sheave axis of rotation, the sheave 114 is displaced within its plane of rotation, shifting its axis of rotation within said plane of rotation and thereby accommodating the added diameter of the fixed flotation device, permitting passage of the increased diameter flotation/umbilical cable combination while maintaining centering within the bell mouth. Upon reaching its fully retrieved position, the umbilical cable is captured within latching mechanism 202. During deployment, upon passage of the larger diameter portion of the umbilical cable, the process is reversed and the sheave returns to its retracted position.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A movable sheave for a payload retrieval and deployment device comprising:

a rotatable sheave defining a plane of rotation and having an axis of rotation perpendicular to said plane;

means effective for adjustably positioning said axis within said plane;

said means effective for adjustably positioning said axis of rotation is at least one sprocket in mechanical engagement with said sheave and having an eccentrically positioned axis of rotation with respect to said sheave; and at least one sprocket driving means constructed and arranged to rotatably engage said sprocket about its axis of rotation;

whereby upon energizing of said sprocket driving means said sheave axis of rotation is adjustably positioned within said sheave plane of rotation whereby said sheave is positioned to accommodate an umbilical cable having a variable diameter.

2. The movable sheave for a payload retrieval and deployment device of claim 1 further including:

at least one sprocket in mechanical engagement with said sheave having a concentrically positioned axis of rotation with respect to said sheave; and at least one sprocket driving means constructed and arranged to rotatably engage said sprocket;

whereby upon energizing of said sprocket driving means said sheave is caused to rotate independently of any rotation imparted thereto by contact with said umbilical cable.

3. The movable sheave for a payload retrieval and deployment device of claim 1 further including means effective for maintaining tension on said umbilical cable by causing said sheave to rotate.

4. The movable sheave for a payload retrieval and deployment device of claim 1 further including at least one detection means effective for determining variations in umbilical cable diameter, said detection means controllably coupled to said means for adjustably positioning wherein variations in cable diameter cause said sheave to be adjustably positioned within said sheave plane of rotation.

5. A system for retrieval and deployment of a variable diameter umbilical cable comprising:

an umbilical cable having a first larger diameter end and a second smaller diameter end;

said first end being in mechanical engagement with a payload;

said second end being in mechanical engagement with a drive means;

said drive means constructed and arranged for traversing said umbilical cable;

a docking head for winding said umbilical cable having a rotatable sheave adapted to accommodate said variable diameter umbilical cable;

said rotatable sheave defining a plane of rotation and having an axis of rotation perpendicular to said plane and;

an actuating cylinder mounted on said docking head with a movable piston connected to said sheave effective for adjustably positioning said axis of rotation within said plane in response to the change between said first larger diameter end and said second smaller diameter end of said umbilical cable;

whereby said sheave is adjustably positioned for accommodating said variable diameter umbilical cable.

6. The system for retrieval and deployment of a variable diameter umbilical cable in accordance with claim 5 further including means effective for maintaining tension on said umbilical cable by causing said sheave to rotate.

7. The system for retrieval and deployment of a variable diameter umbilical cable in accordance with claim 6 wherein said means effective for maintaining tension on said umbilical cable include:

at least one sprocket in mechanical engagement with said sheave and having a concentrically positioned axis of rotation with respect to said sheave; and at least one sprocket driving means constructed and arranged to rotatably engage said sprocket;

whereby upon energizing of said sprocket driving means said sheave is caused to rotate independently of any rotation imparted thereto by contact with said umbilical cable.

8. The system for retrieval and deployment of a payload in accordance with claim 5 further including at least one detection means effective for determining variations in umbilical cable diameter, said detection means controllably coupled to said means for adjustably positioning wherein variations in cable diameter cause said sheave to be adjustably positioned within said sheave plane of rotation.

9. A process for winding an umbilical cable having a variable diameter comprising:

providing a umbilical cable having a first larger diameter end and a second smaller diameter end;

mechanically engaging said first end with a payload;

mechanically engaging said second end with a drive means for traversing said umbilical cable;

providing a docking head for winding said umbilical cable having a rotatable sheave which defines a plane of rotation, has an axis of rotation perpendicular to said plane and is adapted to accommodate a variable diameter umbilical cable; and providing means effective for adjustably positioning said axis of rotation within said plane in response to the change in said first larger diameter end and said second smaller diameter end of said umbilical cable;

whereby, said rotatable sheave, is adjustably positioned for accommodating said variable diameter umbilical cable.

10. The process for winding an umbilical cable having a variable diameter in accordance with claim 9 further including:

providing means effective for maintaining tension on said umbilical cable by causing said sheave to rotate.

11. The process for winding an umbilical cable having a variable diameter in accordance with claim 9 further including:

providing at least one detection means effective for determining variations in umbilical cable diameter, whereby detection of said variations in cable diameter cause said sheave to be adjustably positioned within said sheave plane of rotation.

* * * * *